US006634365B2

(12) United States Patent
Barkmann et al.

(10) Patent No.: US 6,634,365 B2
(45) Date of Patent: Oct. 21, 2003

(54) METHOD OF AND APPARATUS FOR HOMOGENIZING STREAMS OF PARTICULATE FIBROUS MATERIAL

(75) Inventors: Ralf Barkmann, Hamburg (DE); Reinhard Hoppe, Tespe (DE); Thomas Juschus, Drage (DE); Peter Schumacher, Elmshorn (DE); Rolf Lindemann, Glinde (DE)

(73) Assignee: Hauni Maschinenbau AG, Hamburg (DE)

( * ) Notice: Subject to any disclaimer, the term of this patent is extended or adjusted under 35 U.S.C. 154(b) by 84 days.

(21) Appl. No.: 09/908,734

(22) Filed: Jul. 20, 2001

(65) Prior Publication Data

US 2002/0017307 A1 Feb. 14, 2002

(30) Foreign Application Priority Data

Jul. 20, 2000 (DE) ..... 100 35 692

(51) Int. Cl.[7] ..... A24C 1/02

(52) U.S. Cl. ..... 131/108; 131/110; 131/282; 131/287; 131/84.3

(58) Field of Search ..... 131/108, 109.2, 131/110, 84.1, 84.2, 84.3, 84.4, 282, 287; 198/370.11; 406/88, 74, 95; 241/41

(56) References Cited

U.S. PATENT DOCUMENTS

| | | | |
|---|---|---|---|
| 3,648,035 | A | 3/1972 | Hart et al. |
| 4,564,027 | A | 1/1986 | Heitmann |
| 4,889,138 | A | 12/1989 | Heitmann et al. |
| 4,986,285 | A | 1/1991 | Radzio et al. |
| 5,009,238 | A | 4/1991 | Heitmann |

FOREIGN PATENT DOCUMENTS

| | | |
|---|---|---|
| DE | 27 07 253 | 11/1977 |
| DE | 43 36 453 A 1 | 4/1995 |
| DE | 199 01 087 A 1 | 7/2000 |

*Primary Examiner*—James Derrington
*Assistant Examiner*—Carlos Lopez
(74) *Attorney, Agent, or Firm*—Venable LLP; Robert Kinberg; Catherine M. Voorhees

(57) ABSTRACT

A shower of tobacco particles is fed into the upper end of a downwardly sloping and downwardly tapering funnel-shaped part of a conveyor wherein the particles gather into a flow of interlaced particles. Successive increments of the flow are acted upon by one or more jets of air issuing from at least one nozzle which loosens successive foremost increments of the flow prior to admission into a tobacco filler rod forming unit in a cigarette rod making machine.

42 Claims, 3 Drawing Sheets

METHOD OF AND APPARATUS FOR HOMOGENIZING STREAMS OF PARTICULATE FIBROUS MATERIAL

CROSS-REFERENCE TO RELATED CASES

The present application claims the priority of the commonly owned copending German patent application Serial No. 100 35 962.3 filed Jul. 20, 2000. The disclosure of the above-referenced German patent application, as well as that of each US and foreign patent and patent application identified in the specification of the present application, is incorporated herein by reference.

BACKGROUND OF THE INVENTION

The invention relates to improvements in methods of and in apparatus for regulating the density of elongated streams of comminuted natural, artificial and/or reconstituted tobacco or other particulate material prior to processing or further processing of such material, e.g., in a tobacco rod making machine. More particularly, the invention relates to improvements in methods of and in apparatus for making one or more streams or flows of discrete particles, such as comminuted tobacco ribs and/or comminuted tobacco leaf laminae. Still more particularly, the invention relates to improvements in methods and apparatus of the type disclosed in commonly owned German patent application Serial No. 43 36 453 A 1 of Manfred Kaluza published Apr. 27, 1993.

The published German patent application of Kaluza discloses a hopper (also called distributor) which is designed to supply one or more flows of tobacco particles to the rod forming station of a cigarette rod making or an analogous tobacco processing machine. The hopper of Kaluza employs a downwardly extending and downwardly diverging funnel-shaped housing the upper end portion of which receives a continuous stream of tobacco particles from a drum-shaped carded conveyor cooperating with a rapidly driven picker roller and being located at the lower end of an upright tobacco supplying duct. The hopper has two confronting sidewalls which flank a downwardly extending path for tobacco particles being propelled downwardly by the aforementioned picker roller. The sidewalls have orifices forming part of nozzles which admit jets of air transversely against the respective sides of the descending particle stream. The nozzles at one of the sidewalls are staggered vertically relative to the nozzles at the other sidewall so that successive increments of the descending stream are alternatingly deflected and thereby loosened by the jets of gaseous fluid issuing from the orifices of the nozzles at the respective sidewalls of the duct. Such treatment of the descending stream of tobacco particles results in a loosening or singularizing of the body or mass of downwardly advancing tobacco particles. The thus pretreated partially loosened descending stream is thereupon subjected to additional mechanical and pneumatic treatments which are intended to impart to the developing flow of tobacco particles an optimum consistency for conversion into a tobacco rod which is ready to be converted into a so-called filler adapted to be confined in a tubular envelope consisting of cigarette paper or other suitable wrapping material.

The additional mechanical and/or pneumatic treatment is intended to segregate fragments of tobacco ribs from so-called tobacco leaf laminae (shredded tobacco leaves) prior to draping of the rod-like filler into the running web of cigarette paper or the like. The segregation of comminuted ribs from the comminuted (such as shredded) tobacco leaf laminae is intended to reduce the likelihood of undesirable puncturing of the cigarette paper web by fragments of relatively hard tobacco ribs.

An apparatus similar to that disclosed in the published German patent application of Kaluza is disclosed in U.S. patent application Ser. No. 09/482,679 corresponding to published German patent application No. 199 01087.

OBJECTS OF THE INVENTION

An object of the invention is to provide a novel and improved method of manipulating accumulations of particulate material, such as mixtures of comminuted tobacco ribs and tobacco leaf laminae, in a gentle and highly reliable (reproducible) manner.

Another object of the invention is to provide a novel and improved method of processing streams or flows of particles which are about to be converted into the rod-like fillers of cigarettes, cigarillos and analogous smokers' products.

A further object of the present invention is to provide a method which renders it possible to eliminate so-called density holes (randomly occurring regions or portions of a tobacco stream wherein the density deviates appreciably from the densities of neighbouring portions) in the flow of tobacco particles being caused to advance through the distributor or hopper of a cigarette rod making machine or an analogous machine for the mass production of smokers' products.

An additional object of the invention is to provide a method which renders it possible to carry out a novel and improved treatment of a tobacco stream about to be converted into the filler or fillers of one or more continuous cigarette rods or the like.

Still another object of the invention is to provide a method which renders it possible to enhance the homogeneousness of the rod-shaped filler of a continuous rod that can be subdivided into a file of plain cigarettes, cigars, cigarillos or analogous smokers' products.

A further object of the invention is to provide a novel and improved distributor or hopper for use in a machine for making plain cigarettes, cigarillos, cigars and analogous smokers' products.

Another object of the instant invention is to provide a novel and improved combination of parts which can be utilized to increase or enhance the homogeneousness of one or more streams of fibrous particles, such as comminuted tobacco leaves.

An additional object of the invention is to provide a novel and improved system of nozzles which can be utilized in the distributor or hopper of a cigarette rod making or an analogous machine.

Still another object of the invention is to provide a novel and improved apparatus for homogenizing a stream of shredded tobacco leaf laminae, with or without tobacco ribs, in the distributor or hopper of a cigarette rod making machine.

A further object of the instant invention is to provide novel and improved cigarettes, cigarillos, cigars or analogous rod-shaped smokers' products.

Another object of this invention is to enhance the homogeneousness of the tobacco fillers in cigarettes, cigars, cigarillos or other rod-shaped tobacco-containing products

SUMMARY OF THE INVENTION

One feature of the present invention resides in the provision of an apparatus for regulating the density of elongated streams of particulate material, such as comminuted tobacco leaves. The improved apparatus comprises a conveyor having an inlet and at least one outlet and defining an elongated path extending from the inlet to the at least one outlet, and means for treating a stream of particulate material in the conveyor. The treating means comprises a compacting unit which is designed to densify successive increments of the stream at the inlet with attendant conversion of successive increments of the stream into successive increments of at least one modified stream (hereinafter called flow to distinguish it from the stream which is being admitted into the path) wherein at least some of the particles are interlaced with and/or otherwise brought closer to each other, and at least one means for changing the speed of successive increments of the flow in the conveyor to at least substantially singularize the particles not later than at the at least one outlet of the conveyor.

The apparatus can further comprise means (such as an at least substantially upright duct and/or a so-called combing roller or an equivalent thereof) for advancing successive increments of the stream toward the inlet along a second path, and means (such as a so-called picker roller which co-operates with the combing roller) for transferring successive increments of the stream from the second path into the inlet of the elongated path.

In accordance with a presently preferred embodiment, the compacting unit includes at least one pneumatic stream compacting device; such compacting device can comprise at least one nozzle which is arranged to direct at least one stream (hereinafter called jet to distinguish it from the aforementioned stream of particulate material) of a compressed gaseous fluid against successive increments of the stream in the elongated path.

The conveyor can be set up to advance the increments of the stream of particulate material at a first speed, and the speed changing means can include means (such as one or more compressed air discharging nozzles or a mechanical means such as a picker roller or a brushing roller or brush cylinder) for advancing successive increments of the at least one flow at a different second speed. Such speed changing means can be provided with a surface which extends in the conveyor in a direction from the inlet toward the at least one outlet and defines a portion of the elongated path. At least a portion of such surface can have an arcuate shape. For example, the surface can include an at least substantially horizontal first portion and a second portion which slopes upwardly in a direction from the at least substantially horizontal first portion toward the at least one outlet. The slope of the second portion of the aforementioned surface preferably increases in a direction toward the at least one outlet. The at least one speed changing means of such apparatus can further include at least one nozzle which is provided at the aforementioned surface and is arranged to direct at least one jet of air or another suitable gaseous fluid against successive increments of the flow in the conveyor. The at least one nozzle can be provided at (e.g., in) an at least substantially smooth portion of the surface.

As already mentioned above, the at least one speed changing means can include at least one nozzle which is arranged to direct at least one particle accelerating jet of a gaseous fluid against successive increments of the at least one flow in the conveyor. Such nozzle can be provided with at least one substantially slit-shaped fluid discharging orifice, and the orifice can extend at least substantially transversely of at least a portion of the elongated path. The at least one speed changing means can further comprise an arcuate surface which bounds a portion of the elongated path between the at least one nozzle and the at least one outlet of the conveyor; the at least one nozzle can be provided with an orifice which is arranged to discharge into the elongated path at least one jet of a suitable gaseous fluid along an arcuate path which merges gradually into the elongated path. At least one of the just discussed paths can have an arcuate shape, at least at the location or locus of merger of the second path into the elongated path.

The speed changing means of the improved apparatus can have a plurality of discrete speed changing devices at least one of which preferably includes at least one nozzle which is arranged to direct at least one particle accelerating jet of a gaseous fluid against successive increments of the at least one flow of particulate material in the conveyor.

The conveyor can be assembled of two or more neighbouring conveyor sections, and the at least one speed changing means can include a gas discharging nozzle having an orifice which is defined by two neighbouring sections of such conveyor.

The improved apparatus can further comprise means for controlling or regulating the operation of the conveyor and/or of the compacting unit. Such regulating or control means can comprise at least one sensor which is set up to monitor the thickness of the at least one flow of particulate material in the elongated path and/or the density of the at least one flow in the elongated path and/or the pressure of air in a chamber which is adjacent the elongated path in the region of the at least one outlet of the conveyor.

Another feature of our invention resides in the provision of a method of making at least one flow of particles of fibrous material, for example, randomly intermixed and/or interlaced tobacco shreds and fragments of tobacco ribs. The improved method comprises a first step of advancing a stream of particles from a first path into an inlet of an elongated second path having at least one outlet which is remote from the inlet. This first step includes compacting successive increments of the stream at the inlet of the second path with attendant interlacing and/or intermixing of at least some particles in successive increments of the thus obtained at least one flow, and the method further comprises the step of accelerating successive increments of the at least one flow in the second path to thus at least substantially singularize and/or otherwise loosen the particles not later than at the at least one outlet.

The accelerating step can include directing at least one jet of air or another suitable gaseous fluid against successive increments of the at least one flow in the second path.

The advancing step can further include moving the stream at a first speed, and the compacting step can include reducing the speed of successive increments of the stream from the first speed to a second speed; this compacting step can include directing at least one second jet of a gaseous fluid against successive increments of the at least one flow in the second path. The speed reducing step can include reducing the speed to approximatey a fifth or even a tenth or even less in comparison to a maximum speed of the stream of particles before the step of accelerating successive increments of the at least one flow in the second path to thus at least substantially singularize and/or otherwise loosen the particles.

The accelerating step can be carried out in a predetermined portion of the second path, and the method can further comprise the step of densifying the at least one flow between the inlet and the predetermined portion of the second path.

The compacting step can include imparting to successive increments of the at least one flow a density which is at least substantially uniform as considered transversely of the second path.

The accelerating step can include propelling the particles along the second path at least substantially in a direction toward the at least one outlet of the second path.

The method can further comprise the step of regulating the speed of the at least one flow in the second path and/or the speed of the at least one jet. This regulating step can include establishing a pressure differential between longitudinally spaced apart sections of the elongated second path.

The accelerating step can further include causing successive increments of the at least one flow to advance along a guide surface which bounds at least a portion of the second path, and establishing a flow of gaseous fluid between the guide surface and the at least one flow in the second path, which is nearby the guide surface.

The stream can constitute a sifted mass of tobacco particles. The wording sifted mass also means winnowed mass with respect to this invention.

The improved method can further comprise the step of discharging successive increments of the at least one flow from the at least one outlet of the second path into a rod forming station of a cigarette rod making machine or another tobacco rod making machine. Under such circumstances, the advancing and accelerating steps can be carried out in a distributor or hopper of the tobacco rod making machine. Such method can further comprise the step of withdrawing some (surplus) gaseous fluid by suction from the second path upstream of the at least one outlet. The advancing step can include advancing tobacco particles and/or other particles into a second path which has a plurality of outlets, one for each of a plurality of discrete flows of particulate material in the conveyor which defines the second path or paths. The tobacco rod making machine can be arranged to convert the discrete flows of tobacco particles into two discrete tobacco rods. Under such circumstances, the advancing step can include establishing two discrete second paths each of which extends from the inlet to a different outlet.

The improved method can further comprise the step of subdividing the stream in the at least one second path into a plurality of flows subsequent to the accelerating step.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
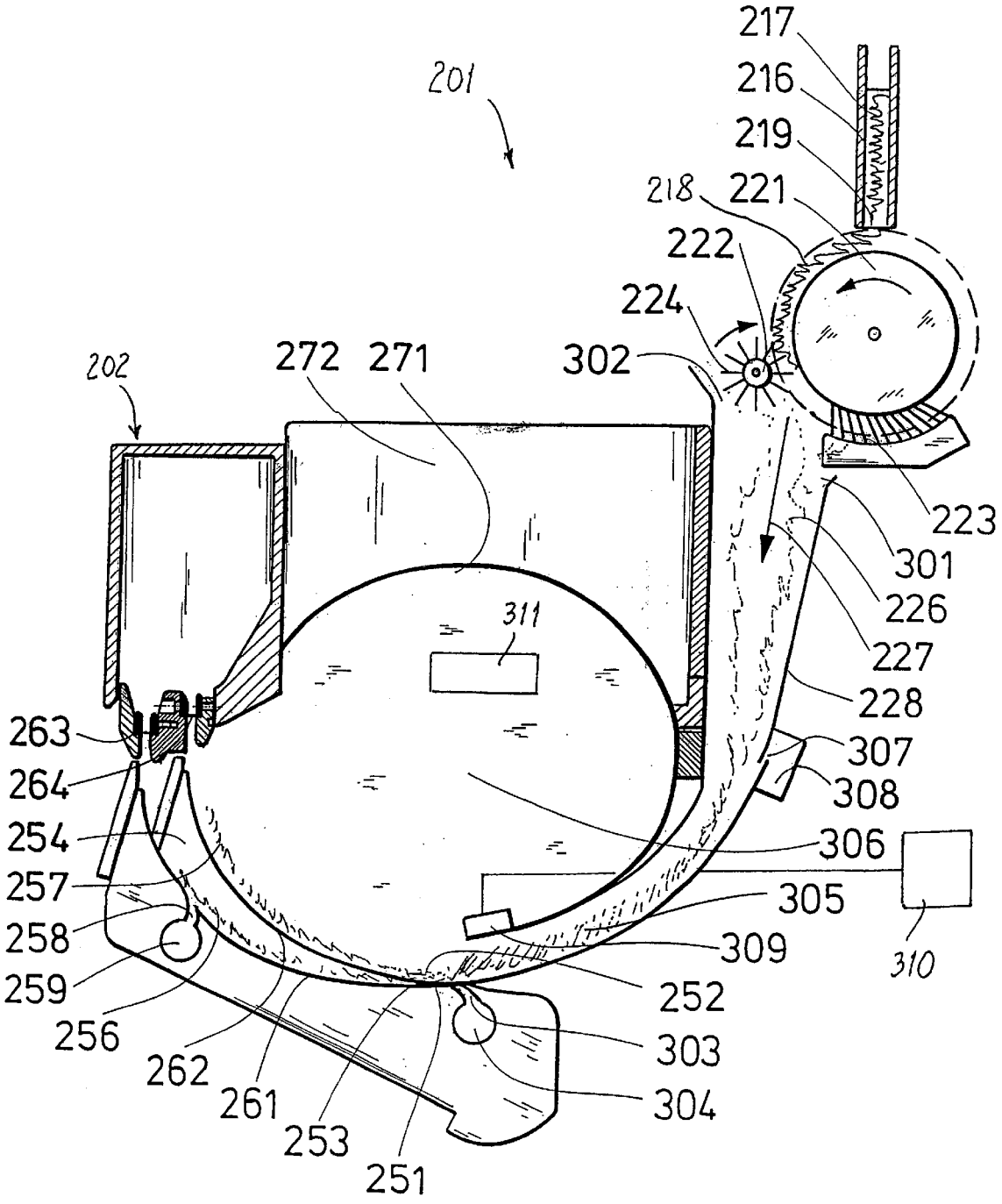
FIG. 1 is a fragmentary schematic partly elevational and partly vertical sectional view of an apparatus which embodies one form of the present invention and is installed in a distributor or hopper of a tobacco rod making machine.

FIG. 1 shows certain details of an apparatus 201 which is designed to regulate the density of an elongated stream 217, 218, 226 of particulate material, e.g., intermixed fragments of tobacco leaves. In many instances, such streams are mixtures of shredded tobacco leaf laminae and comminuted tobacco ribs. The portion or part 217 of the tobacco stream is a column of particles in an upright duct 216 the open lower end or outlet 219 of which is located above the apex of a carded drum 221. The pile or carding 223 of the drum 221 entrains successive increments of the column 217 at the outlet 219 of the duct 216 and forms a layer 218 which is advanced along an arcuate path toward and into the range of the radially outwardly extending needles or pins 224 of a rapidly rotating picker roller 222. The needles 224 expel from the carding 223 a continuous shower 226 of tobacco particles which enter the composite inlet 301, 302 at the upper end of a downwardly tapering upright funnel-shaped confining member 228 wherein successive increments of the developing elongated flow 305 of tobacco particles advance in the direction indicated by an arrow 227. The elongated path defined by a composite conveyor including the duct 216, the drum 221 and the member 228 communicates with the surrounding atmosphere at the composite inlet 301, 302 of the member 228.

The apparatus 201 forms part of a distributor or hopper of a twin cigarette rod making machine, e.g., a machine of the type described and shown in commonly owned U.S. Pat. No. 5,009,238 granted Apr. 23, 1991 to Heitmann for "APPARATUS FOR SUPPLYING FIBROUS MATERIAL TO MACHINES FOR SIMULTANEOUSLY PRODUCING A PLURALITY OF CIGARETTE RODS". This patent illustrates the manner in which the duct 216 can receive a mixture of randomly distributed tobacco particles from a magazine of the distributor or hopper of the cigarette rod making machine. Thus, the upper end of the duct 226 can receive successive batches of tobacco particles from a so-called elevator conveyor which, in turn, draws such batches from a suitable magazine or hopper. The height of the column 217 of tobacco particles in the duct 216 is monitored by one or more sensors which control the rate of delivery of tobacco particles by the aforementioned elevator to thus ensure that the height of the column 217 remains at least substantially constant. The monitored value of the height can be used for regulation or control. The confining member 228 also forms part of a composite conveyor which further comprises an elongated arcuate guide 251 arranged to receive from the member 228 the continuous flow of tobacco particles and to guide such flow toward a rod forming station 202 of the cigarette rod making machine further including the aforementioned distributor or hopper which includes or accommodates the improved apparatus 201. The elongated path which is defined by the composite conveyor 228, 251 has an inlet at 301, 302 and two outlets 263, 264 at the points of entry of successive increments of two parts or sections 256, 257 of the flow 305 into the rod forming station 202 of the cigarette rod making machine.

The duct 216 and the carded drum 221 together constitute a means for advancing successive increments of the stream 217, 218 along a second path toward and into the inlet 301, 302 of the elongated path defined by the conveyor 228, 251, and the picker roller 222 and its needles 224 together constitute a means for transferring successive increments of the stream 217, 218 into the inlet 301, 302 of the elongated path for successive increments of the flow 305.

The means for treating successive increments of the stream 217, 218, 226 of particulate material in the elongated path extending from the inlet 301, 302 to the outlets 263, 264 of the conveyor 228, 251 includes a compacting unit with at least one pneumatic stream compacting device or nozzle 307 receiving compressed air from a plenum chamber 308 and having at least one orifice provided in one wall of the member 228 and arranged to discharge at least one jet of compressed air into the direction of advancement of the stream of tobacco particles. This converts successive increments of the stream into successive increments of the flow 305 wherein at least some of the tobacco particles are or can be interlaced or similarly engaged with each other.

The treating means of the apparatus 201 which is shown in FIG. 1 further comprises two nozzles 303, 258 which together constitute a means for changing the speed of successive increments of the flow 305 in the conveyor 228, 251 to at least substantially singularize the particles not later than at the outlets 263, 264 so that the rod forming station 202 receives two flow sections 256, 257 of loose or loosened tobacco particles. The flow 305 in the confining member 228 is advanced (mainly by gravity and also by the gaseous fluid issuing from the orifice of the nozzle of the stream compacting unit 307) at a first speed, and the nozzles 303, 258 constitute a means for advancing successive increments of the flow 305 at a higher second speed. The speed of the flow 305 decreases on the way to the nozzle 303 due to the upward curve of the surface 251. These nozzles respectively co-operate with arcuate surfaces 262, 261 which extend in the conveyor 228, 251 in a direction from the inlet 301, 302 toward the outlets 263, 264 and thus define portions of the elongated path between the inlet 301, 302 and the outlets 263, 264.

The surfaces 261, 262 form part of a composite surface which further includes a substantially horizontal portion 253; the surfaces 261, 262 slope from the horizontal surface portion 253 upwardly toward the respective outlets 263, 264. The inclination or slope of each of the illustrated surfaces 261, 262 increases gradually all the way from the horizontal surface portion 251 to the respective outlets 263, 264.

The air streams which are admitted into the member 228 at the composite inlet 301, 302 and through the orifice of the nozzle 307 serve to compact (densify) successive increments of the tobacco shower 226. The jets of air entering at the inlet 301, 302 are sucked into the member 228, and the jet of air entering through the nozzle 307 is blown in the direction of the advancement of the shower 226. All such jets contribute to a densification or compacting of that portion of the stream which is caused to advance in the member 228.

The shower 226 constitutes a sifted mass of tobacco particles. Such sifting is effected upstream of the duct 216, i.e., in the aforementioned distributor or hopper of the cigarette rod making machine. Reference may be had again to the aforementioned U.S. Pat. No. 5,009,238 to Heitmann which also shows suitable sifting means but downstream of the duct. As a rule, or in many instances, sifting involves directing against a stream of tobacco particles a jet of compressed air which flows transversely of and against the stream (e.g., a shower of tobacco particles which shower contains shreds and fragments of shreds (i.e., lighter tobacco particles) and fragments of tobacco ribs, (i.e., heavier tobacco particles). The jet expels lightweight particles from the shower but permits heavier particles to descend by gravity. The heavier particles normally entrain some lightweight particles and, therefore, the sifting operation preferably further includes the step of segregating such entrained lightweight particles from the ribs. The just described sifting can be identical with or analogous to that described in the passage beginning in line 59 of column 4 and ending in line 24 of column 5 in the specification of the patent to Heitmann; however, and as already mentioned hereinbefore, it is presently preferred to sift the stream of tobacco particles ahead (upstream) of the duct 216 so that all particles of the shower 226 are acceptable for incorporation into the fillers of cigarette rods or the like.

Successive increments of the flow 305 which are propelled by the nozzle 303, 258 toward the outlets 263, 264 advance along the part 251 of the composite conveyor 228, 251, either in actual contact with the upper side or surface of such part or on a layer or cushion of air which exists between the part 251 and the flow 305 and is supplied by the nozzle 307 or by this nozzle in conjunction with the slots at the inlet 301, 302 of the tubular member 228. The slots at the inlet 301, 302 can also be used to create a stream, a layer or a cushion of air which streams mainly between the shower of particles or tobacco and/or the flow and at least one of a side 415, 416 of the conveyor 228, 251 (See FIG. 3).

The velocities of successive increments of the flow 305 advancing along the upper side or surface of the guide 251 decreases, primarily due to the upward curve of the guide surface 251. The upper side or surface of the guide 251 has a downward slope between the orifice of the nozzle 307 and the horizontal portion of such surface at 253, a horizontal portion at 253, and thereupon the upwardly sloping portions or surfaces 261, 262. Such configuration of the upper side or surface of the part 251 of the composite conveyor 228, 251 contributes to condensation or densification of successive increments of the flow 305 with attendant increase of the density or height of such flow on its way toward the locus of division into the two smaller flows 256, 257 which are caused to advance outwardly toward the respective outlets 263, 264.

The improved apparatus 201 further comprises at least one arrangement which regulates the operation of the conveyor 228, 251 and/or of the tobacco compacting unit including the aforementioned nozzle 307 and slots 301,302. This regulating arrangement preferably includes a plurality of sensors including a sensor 309 which monitors at least one parameter of the flow 305. The illustrated sensor 309 is designed to monitor the density and/or the height (cross-sectional area) of the flow 305 at the horizontal portion of the upper side or surface of the part 251 of the composite conveyor 228, 251. The output of the sensor 309 is connected with one input of a control unit 310 (such as a microprocessor) which processes the incoming signals and transmits appropriate signals to the means for regulating the characteristics of the jet or jets of air issuing from the nozzle 307, the speed of the carded drum 221, the pressure of fluid in the plenum chambers 304, 259 which respectively supply fluid to the nozzles 303, 258 and/or other variables which can influence the relevant characteristic(s) of the flow 305.

The sensors can be i.e. of an ultrasonic type or distance sensors using at least a laser. The laser sensor can be i.e. a LAS OMRON Z4M-W of the company OMRON, One East Commerce Drive, Schaumburg, Ill. 60173, USA. The ultrasonic sensor can be a UNDK 30 of the company Baumer electric, or a sensor named UC300-F43-2KIR2-V17 of Pepperl+Fuchs Inc., 1600 Enterprise Parkway, Twinsburg, Ohio 44087, USA.

The nozzle 303 is preferably arranged to direct a jet of compressed gaseous fluid (air) from the respective plenum chamber 304 into the elongated path for the flow 305 on its way along the horizontal portion of the upper side or surface of the conveyor portion 251. This results in a pronounced loosening of the flow 305, i.e., in a high rate of separation of previously interlaced or intertwined tobacco particles from each other. The inclination of the orifice of the nozzle 303 can be such that the jet of air issuing from the orifice(s) of this nozzle 303 forms a layer or film which impacts with the flow 305 and facilitates an acceleration of the tobacco particles in the direction of advancement. Near the nozzle 303 the guide surface 251 seperates into two discrete surfaces 261 and 262, which lie behind each other in FIG. 3. These surfaces are curved differently and serve to divide the flow 305 into two discrete flows 256, 257.

The discrete flows 256, 257 are propelled along the respective concave surface portions 261, 262 by jets of compressed air issuing from nozzles 258 (only one can be seen in FIG. 1) located upstream of the respective outlets 263, 264. Each nozzle 258 receives compressed air from a discrete plenum chamber 259 or from a common plenum chamber. The reference character 254 denotes a partition which is disposed between the concave surfaces 261, 262 and separates the flows 256, 257 from each other.

The two outlets 263, 264 admit finished flows 256, 257 of tobacco particles into two discrete sections of the twin-lane rod forming machine which includes the rod forming station 202. Each of these flows is converted into a discrete rod-like filler which is draped into a running web of cigarette paper or the like to form therewith a continuous cigarette rod ready to be subdivided into plain cigarettes of unit length or multiple unit length. Each cigarette rod maker can be of the type described, for example, in commonly owned U.S. Pat. No. 4,986,285 granted Jan. 22, 1991 to Radzio et al. for "METHOD AND APPARATUS FOR ASCERTAINING THE DENSITY OF WRAPPED TOBACCO FILLERS AND THE LIKE".

The outlets 263, 264 admit tobacco particles against the undersides of the lower reaches of two endless foraminous belts. Such lower reaches advance beneath two discrete suction chambers or beneath a common suction chamber to gather growing tobacco streams and to move such streams in directions at right angles to the plane of FIG. 1. The fully grown tobacco streams are trimmed to yield two rod-like fillers which are draped into continuous cigarette paper webs to form therewith two continuous cigarette rods. The leaders of such rods are severed by so-called cut-offs to yield two files or rows of plain cigarettes of unit length or multiple unit length. Reference may be had, for example, to FIG. 1 of the aforementioned U.S. Pat. No. 4,986,285 to Radzio et al. which shows a machine serving to convert a single flow of tobacco particles into a cigarette rod. The means for converting two rod-like flows of tobacco particles into rod-like fillers of two cigarette rods is also disclosed in commonly owned U.S. Pat. No. 4,889,138 granted Dec. 26, 1989 to Heitmann et al. for "METHOD OF AND APPARATUS FOR SIMULTANEOUSLY MAKING PLURAL TOBACCO STREAMS".

Figure 3:
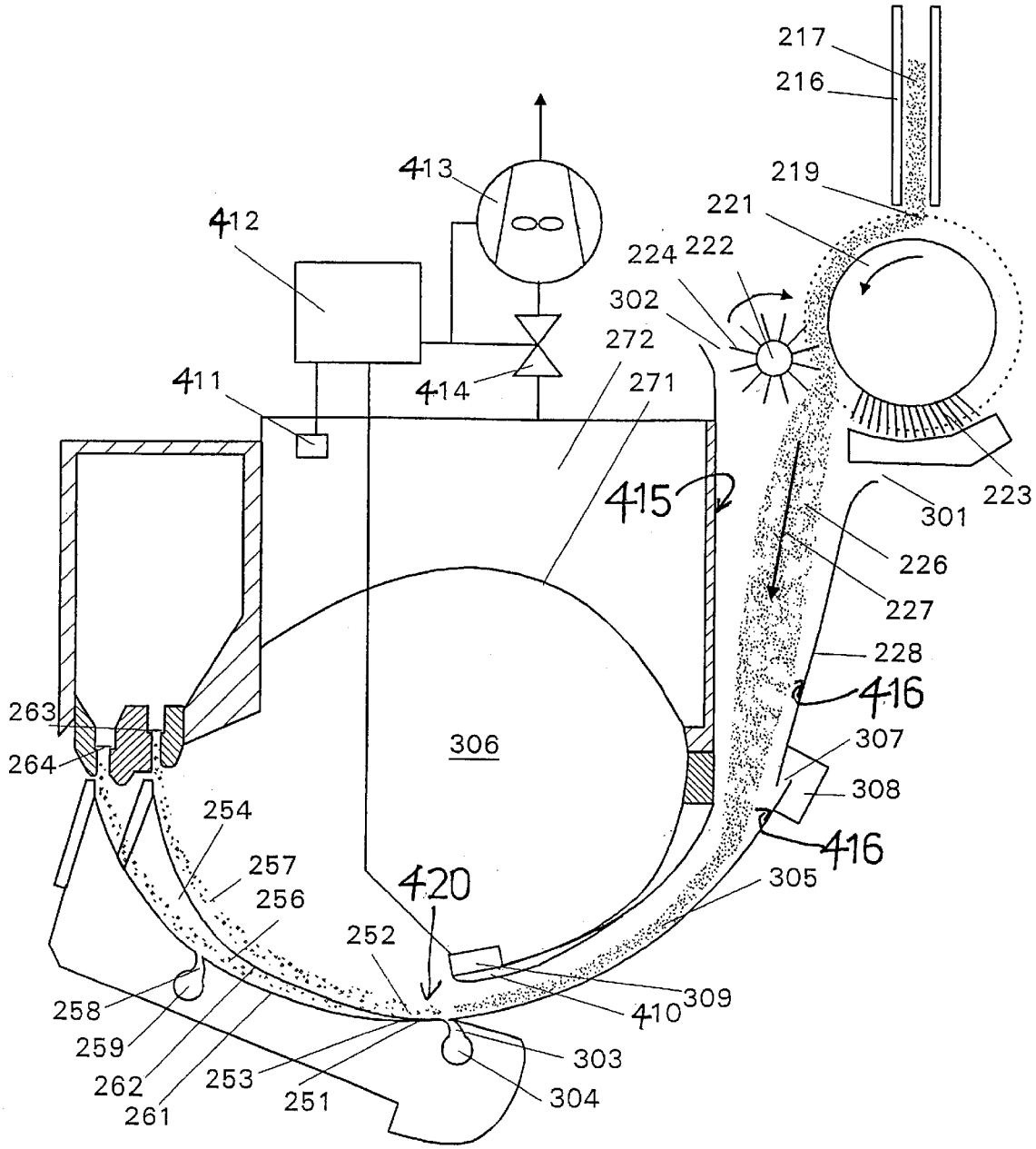
FIG. 3 is a fragmentary schematic partly elevational and partly vertical sectional view of an apparatus which embodies another form of the present invention and is installed in a distributor or hopper of a tobacco rod making machine.

The surplus of air being supplied by the nozzles 307, 303 and 258 is gathered in an air accumulating compartment 306 upsteam of the outlets 263, 264 and is caused to flow through a sieve 271 and into an expansion chamber 272. In the embodiment of FIG. 3 the surplus of air is removed by a fan 413.

The operation of the apparatus 201 is as follows:

The lower end of the column 217 of tobacco particles in the duct 216 is subjected to a comminuting or loosening action by the carding 223 of the rotating drum 221. The pins or needles 224 of the picker roller 222 expel tobacco particles from the carding 223 and propel (arrow 227) such particles through the inlet 301, 302 of the member 228. The shower 226 is compacted between jets of air entering the duct 228 through the slots 301, 302 and flowing close to the walls of duct 228. An additional sliding cushion of air can be inserted by nozzle 307. While sliding between said jets of air the speed of shower 226 continuosly decreases due to the upward curve of the guide surface 251. Simultaniously, the density of the flow 305 increases and the particles of the flow start to interlace with each other.

Successive increments of the flow 305 are accelerated by the jet of compressed air issuing from the orifice of the nozzle 303 in the region of the part 251 of the composite conveyor 228, 251. The nozzle 303 is or can be provided with an orifice which extends transversely of the path for advancement of successive increments of the flow 305 toward the rod forming station 202. The purpose of the nozzle 303 is to spread the flow 305 in te direction of advancement, i.e., to effect a loosening or separation of its particles; such loosening can take place while the particles slide directly along the upper side of the conveyor portion 251.

The optimal speed of sliding movement and hence the density of the flow immediately ahead of the nozzle 303 is preferably determined by the pressure in the compartment 306, i.e., in the space which is bounded by the conveyor portion 251 and the sieve 271. If the pressure of air in the compartment 306 is reduced, this entails an increase of the speed of air flow (arrow 227) in the member 228 and hence a reduction of density of the flow 305 upstream of the nozzle 303. Such mode of operation reduces the comminuting or separating action of air upon the flow 305 and thus increases the likelihood of non-uniformity of the flows 256, 257 advancing toward the respective outlets 263, 264.

The uniformity of the flows 256, 257 is also reduced if the height (cross-sectional area) of the flow 305 is above a certain value because this prevents the nozzles 303, 258 from effecting an optimum or a satisfactory loosening of the flow 305. One of the purposes of the control unit 310 including the sensor 309 is to regulate the height of the flow 305 by regulating the pressure of air in the compartment 306.

Experiments with the improved apparatus indicate a pronounced increase of the uniformity of consistency of flows 256, 257 and a higher than 50% reduction of so-called density holes in these flows, as well as a reduction of deviation from standard by more than 19%. It was further ascertained that the improved apparatus effectively prevents a gathering of tobacco particles into clumps within the compartment 306.

Figure 2:
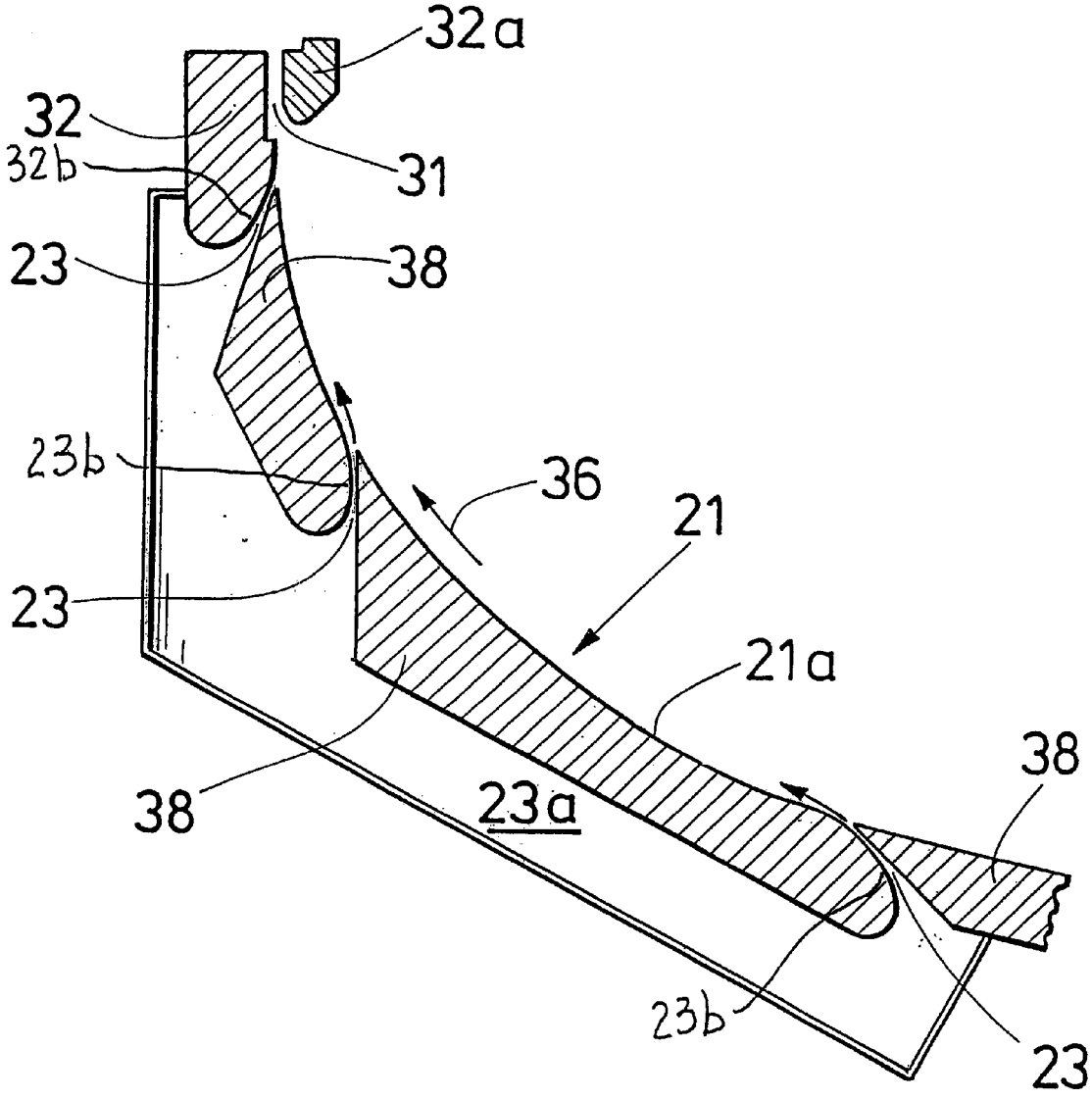
FIG. 2 is a fragmentary vertical sectional view of an apparatus which constitutes a modification of the apparatus shown in FIG. 1.

FIG. 2 shows a portion of a modified apparatus wherein the nozzles 303, 258 of FIG. 1 are replaced by three nozzles 23 receiving compressed air from a common plenum chamber 23*a*. That portion (21) of the conveyor which guides successive increments of the tobacco flow in the direction of arrow 36 toward the illustrated outlet 31 includes several sections 38 defining orifices for the nozzles 23. The uppermost orifice is defined by the uppermost section 38 and a sidewall 32 which forms part of the tobacco rod making machine and co-operates with a second sidewall 32*a* to define the outlet 31.

The generatrix or generatrix function or curve of the concave surface 21*a* provided on the conveyor portion or part 21 and serving to guide successive increments of the tobacco flow toward the outlet 31 is based on a uniform envelope curve so that the sections 38 of the conveyor portion 21 can establish smooth transitions for advancement of the tobacco flow toward the rod forming station accommodating the sidewalls 32 and 32*a*. The definition of the uniform envelope curve can be found in Brockhaus "Naturwissenschaft und Technik", Wiesbaden, Germany, 1983 or in Hütte, "Taschenbuch der Technik, Mathematik" $2^{nd}$ ed., 1974, Springer-Verlag Berlin Heidelberg N.Y. The orifices of the nozzles 23 can constitute slits which extend at right angles to the plane of FIG. 2 and can extend all the way across the respective portions of the path for the tobacco flow. The downstream sides of the orifices of the nozzles 23 are bounded by convex facets 23*b* which merge gradually into the adjacent portions of the composite surface 21*a*. Such configuration of the surfaces 21*a*, 23*b* renders it possible to establish an uninterrupted wall flow of compressed air and tobacco particles along the surface 21*a*; this flow is attributable to the well-known Coanda effect.

Successive increments of the tobacco flow advancing along the surface 21*a* are directly contacted by jets of compressed air issuing from the preferably slit-shaped orifices of successive nozzles 23, i.e., the speeds of air jets being furnished by the nozzles 23 assume their maximum values at the times of actual impingement upon the tobacco flow. Since the surface 32*b* of the sidewall 32 is preferably configurated in the same way as the aforedescribed surfaces 32*b*, this sidewall does not interfere with the desired advancement of successive increments of the tobacco flow into the rod forming station of the cigarette rod making machine utilizing a distributor or hopper which embodies the structure shown in FIG. 2.

Tobacco particles which are propelled by the pins or needles 224 of the picker roller 222 into the confining member 228 of the conveyor 228, 251 enter the member 228 owing to the propelling action of the needles or pins 224 on the rapidly rotating picker roller 222 as well as due to the influx of air at the inlet 301, 302 due to suction generated by the jets of air being admitted into the composite conveyor 228, 251 by the nozzles 307 and 303. The air in the downwardly converging portion 228 of the composite conveyor 228, 251 surrounds the shower 226 and condenses it into the aforementioned flow 305 not later than at the level of the nozzle 303. The rate of advancement of the flow 305 into the range of the nozzle 303 is relatively slow.

The jet or jets of air issuing from the nozzle 303 entrains or entrain successive foremost particles of the mass of tobacco particles advancing along the horizontal or substantially horizontal portion (at 253) of the exposed surface of the conveyor portion 251. Such foremost particles are withdrawn (separated) from the nextfollowing portion of the flow 305 and are accelerated in a direction toward the outlets 263 and 264. The surplus of air being admitted by the nozzle 303 enters the compartment 306 and escapes through the sieve 271 into the expansion chamber 272. The manner in which air is being withdrawn from the expansion chamber 272 is regulated by the control unit 310 in response to signals from the sensor 309 (if this sensor is designed to monitor the pressure in the compartment 306) or to signals from a discrete second sensor 311. The nature of regulation is preferably such that the pressure of air in the compartment 306 is constant or fluctuates within a rather narrow range.

In order to establish an optimum relationship between the rate of air inflow at 301 and 302 on the one hand, and the quantity of tobacco particles being advanced through the conveyor 228, 251 on the other hand, such quantity is or can be regulated in dependency upon the RPM of the prime mover for the cigarette rod making machine. As already mentioned hereinbefore, the sensor 309 can be constructed, assembled and installed to continuously transmit signals which indicate the height of the flow 305 at the orifice of the nozzle 303. If the intensity or another characteristic of the signal being transmitted by the sensor 309 is outside of a predetermined acceptable range, the quantity and/or pressure of air in the plenum chamber 308 and/or 304 and/or 259 and/or in the compartment 306 is or can be changed by changing the desired value for the regulation of pressure.

The nozzle 307 can constitute a preferred but still optional feature of the improved apparatus 201. Thus, this nozzle can be deactivated if the flow advancing action of the nozzle 258 and/or 303 suffices to ensure that the shower 226 cannot clog the portion 228 of the composite conveyor 228, 251 for the tobacco flow 305. A clogging of the conveyor portion 228 is most likely to occur during starting of the rod making machine which embodies the structure of FIG. 1 or 2.

An important advantage of the improved method and apparatus is that the flow (FIG. 2) or flows 256, 257 reaching the rod forming station contains or contain a surprisingly high percentage of loose tobacco particles. This contributes to the making of rod-shaped tobacco fillers having an optimum consistency for conversion into the tobacco-containing constituents of cigarettes, cigars, cigarillos or analogous rod-shaped smokers' products In contrast to the arrangement which is shown in the aforementioned published German patent application No. 43 36 453 A 1 of Kaluza and wherein the downwardly converging (narrowing) hopper-shaped conveyor contains nozzles which alternatingly direct streams of compressed air against the opposite sides of the descending tobacco stream, the apparatus of the present invention employs an inlet (301, 302) which directs jets of inflowing air in the direction indicated in FIG. 1 by the arrow 227, namely at least substantially in the direction of forward movement of the shower 226. This brings about a densification of the incipient flow 305, and such densification is enhanced by the jet or jets of air issuing from the orifice of the nozzle 307 because the jet or jets propels or propel successive increments of the flow 305 into the narrowest portion of the conveyor member 228, i.e., toward the sensor 309. It will be seen that the densification of successive increments of the flow 305 can be effected in a very simple but spacesaving and efficient manner, namely by utilizing the funnel-shaped conveyor portion 228 and by causing jets of air (entering at 301, 302 and 307) to flow in the direction (arrow 227) of desired forward movement of successive increments of the stream (shower 226) and thereupon in the direction of forward movement of the incipient flow 305.

All in all, the tobacco stream is loosened by the pins or needles 224 of the picker roller 222 and is thereupon densified by the jets of air entering the conveyor 228, 251 at 301, 302 and 307. The thus obtained flow 305 is loosened by the nozzles 303, 258 or by the nozzles 23 on its way toward the outlets 263, 264 or toward the outlet 31. The admission of air at 301, 302 and 307 in such a way that the respective jets form relatively thin films or layers of air flowing along the inner sides of the respective walls of the conveyor portion 228 also contributes to the avoidance of unnecessary or undesirable expansion of successive increments of the tobacco stream and tobacco flow upstream of the nozzle 303.

The density of successive increments of the flow 305 can increase (preferably gradually) all the way to the orifice or orifices of the nozzle 303. This enhances the homogeneousness of the flows 256, 257 which are or can be acted upon by one or more jets of compressed air entering through the orifice or orifices of the nozzle 258 and ultimately enter the rod forming station 202. As used herein, the term "homogeneousness" is intended to denote a substantially uniform density because interlaced and/or otherwise intertwined fragments (such as shreds) of tobacco leaves cannot guarantee the making of a stream which is homogeneous all the way across each of its cross-sectional areas.

It was further ascertained that, if the mass of filamentary smoking material is admitted by the pins or needles 224 of the picker roller 222 in such a way that successive increments of the shower 226 and the developing flow 305 are advanced in the direction indicated by the arrow 227 (i.e., in the direction of desired advancement of the flow 305 toward the outlets 263, 264), the loosening action of jets of air issuing from the nozzles 303, 259 is even more satisfactory because the densification takes place in the direction of advancement of the properly treated stream sections toward the outlets 263 and 264.

By regulating the speed of the carded drum 221 (i.e., the rate of admission of the filamentary material forming the shower 226 into the portion 228 of the composite conveyor including the parts 228, 251) and/or the rate of flow of compressed air through the orifice(s) of at least one of the nozzles 307, 303, 258 (or of the corresponding nozzles in the apparatus embodying the structure shown in FIG. 2), one can ensure that the consistency of the flows 305, 256, 257 (and of the corresponding flow in the apparatus embodying the structure of FIG. 2) invariably remains within a desired highly acceptable range. The regulation further involves a consideration of the signal or signals denoting the cross-sectional area and/or the density of the stream which is being converted into a flow of relatively loosely coherent particles and/or the rate of delivery of tobacco particles into the conveyor portion 228 per unit of time. If the improved apparatus is arranged to deliver one or more flows of tobacco particles into a cigarette rod making or an analogous tobacco processing machine, one can also take into consideration the intended or desired output of such machine, e.g., the number of cigarettes being turned out per minute. In many modem cigarette making machines (such as the machine which is known as PROTOS and is distributed by the assignee of the present application), such number equals or exceeds 14000. As a rule, it suffices to monitor the density and the cross-sectional area of the tobacco stream and/or of the flow of tobacco particles advancing toward the rod forming station.

The actual regulating step can involve the establishment of pressure differentials. For example, the rate of delivery of tobacco particles by the stream including the shower 226 shown in FIG. 1 can be determined by selecting an appropriate pressure in the compartment 306 and/or in a portion of the path for tobacco particles upstream of such compartment. A higher (more pronounced) pressure differential results in the flow of air from the inlet 301, 302 and/or from the orifice or orifices of the nozzle 307 at a higher speed; this, in turn, results in the making of at least one flow having a relatively low density upstream of the particle accelerating station. Therefore, the comminution or loosening of the tobacco stream is less pronounced but the throughput of the apparatus is higher.

Optimum circumstances for the operation of the improved apparatus can be readily established by persons skilled in this art upon perusal of the preceding disclosure. All that such skilled person has to do is to vary the pressure in the region(s) which determines or determine the rate of flow of tobacco particles toward the rod forming station(s).

If the flow or flows of properly treated tobacco particles is or are to be delivered to a tobacco rod making machine, the important pressure is the pressure or can be that prevailing in the compartment 306 of the apparatus 201 shown in FIG. 1. The tobacco particles slide along the upper side or surface of the conveyor portion 251 first into the range of the nozzle 305 and thereupon into the range of the nozzle or nozzles 258. The optimum velocity of sliding movement along the upper side of the conveyor portion 251 determines the optimum density or densities of the flow 305 or flows 256, 257, and such velocity is a function of the pressure prevailing in the compartment 306. However, it is also possible to influence the density or densities of the flow or flows 305 or 256, 257 as far ahead as in the conveyor portion 228; in fact, a change of pressure in the conveyor portion 228 can exert an unexpectedly pronounced influence upon the parameters of the flows 305, 256 and 257.

As already mentioned hereinbefore, it is often preferred to sift the tobacco prior to admission into the duct 216. Such sifting preferably involves the segregation of all tobacco particles which should not enter the tobacco rod, i.e., the rod-like filler of a cigarette rod. In other words, the conveyor portion 228 in the apparatus 201 of FIG. 1 should receive only such tobacco particles which are acceptable in the rod-like filler of a cigarette, cigar, cigarillo or an analogous rod-shaped smokers' product. As a rule, this normally involves segregation of tobacco ribs, eyes and like relatively hard and rigid parts from shreds of tobacco leaf laminae and artificial or reconstituted tobacco.

It is often preferred to start with a shower (226) of discrete tobacco particles, to thereupon convert the shower into a stream having a density well above that of the shower, to thereupon at least slightly densify the stream, and to thereafter convert the stream into one or more flows of loose or substantially loose particles. Certain additional important advantages of the improved method and apparatus include the following:

The loosening and separation of particles in the stream as well as subsequent controlled condensing of the flow or flows and interlacing of its or their particles can be achieved with the consumption of relatively small amounts of energy, such as for driving certain rotary parts (e.g., 221 and 222) and for establishing and maintaining requisite quantities of pressurized gaseous fluid, such as at 308, 304 and 259 (or at 23*a* and elsewhere in the apparatus embodying the structure of FIG. 2). The rate of deceleration of tobacco particles reaching the upper side or surface of the conveyor part 251 or 21 can be controlled by appropriate selection of fluid pressure in the plenum chamber 308 and/or by appropriate selection of the quantity of tobacco particles in the shower 226 and/or by appropriate selection of configuration of the upper side of the conveyor part 251 or 21 and/or by appropriate selection of pressure differential(s) between longitudinally spaced apart portions of the path defined by the conveyor 228, 251 of FIG. 1 or of the path defined by the conveyor including the part 21 shown in FIG. 2. As already mentioned hereinbefore, the flow of tobacco particles in the conveyor of the improved apparatus can advance along the upper side of the conveyor part 251 or 21 and/or on top of a film or layer of air at such upper side. Condensation (i.e., densification) of the shower (such as 228) of tobacco particles can begin in the first part (228) of the conveyor and proceeds in the second part (such as at 251 or 21).

Reliance on the aforementioned Coanda effect also constitutes a desirable and important novel feature of the improved method. Such effect ensures highly predictable advancement and equally predictable condensation of the flow in or at the second part (251 or 21) of the conveyor. The utilization of nozzles which are provided with slit-shaped orifices extending transversely across a portion of or across the entire path for the tobacco stream or tobacco flow has been found to contribute to highly predictable treatment of tobacco particles in the respective portions of their path.

This also applies for secondary, additional or supplementary air (if utilized) which is being admitted into the path for the tobacco stream and/or for the tobacco flow(s).

The apparatus of FIG. 1 exhibits the advantage that it employs a relatively simple (two-part) conveyor 228, 251. This simplifies the assembly and installation of the improved apparatus in a tobacco rod making machine. On the other hand, the conveyor including the composite second part 21 shown in FIG. 2 exhibits the important advantage that its sections 38 can establish several longitudinally spaced-apart nozzles 23 with optimally configurated surfaces 23*b*, 32*b* for admission of jets of compressed air into selected portions of the path for the tobacco flow or flows. In either event, the improved apparatus exhibits the important advantage that it can be readily adjusted to furnish one or more tobacco flows which exhibit optimal characteristics for conversion into one or more rod-shaped fillers in a cigarette-, cigar- or cigarillo- or other tobacco rod making machine.

FIG. 3 shows a further preferred embodiment of the invention. Compared to the embodiment of FIG. 1 there are provided means for elimimation or at least minimization of jets of air or air flowing through the stream of tobacco at least partly. The means can be at least a tail surface 410 which i provided to minimize off stream components of the air flow. This leads to a more uniform distribution of tobacco.

The uniformity of the flows 256, 257 is also reduced in the embodiment of FIG. 3 if the height (cross-sectional area) of the flow 305 is above a certain value because this prevents the nozzles 303, 258 from effecting an optimum or a satisfactory loosening of the flow 305. One of the purposes of the control system 412 including the sensor 309 is to regulate the height of the flow 305 by regulating the pressure of air in the compartment 306. The control of the height of the flow 305 can also be performed by using the signals of the pressure sensor 411 which measures the pressure in the compartment 306 or the expansion chamber 272.

The signals of the sensors 309 and 411 are transfered to a control system 412, which controls the amount of air being carried away via a throttle, choker valve and/or flow control valve 414 and/or the rotary frequency of a ventilator 413. In FIG. 3 is also shown that the main nozzle 303 to singularize the tobacco is situated near the summit 420 of the surface 261, 262, 416.

In another apparatus according to U.S. Pat. No. 4,564,027 the tobacco shower has a velocity of ca. 10 m/s near the summit, and the density of the tobacco is a few g/l (grams per liter). In an apparatus according to a preferred embodiment of the invention a flow or fleece of tobacco is provided in the region of the summit and the velocity is ca. 1 m/s, whereas the density of the flow of tobacco is ca. 100 g/l. The height is preferably between 1 and 10 mm and especially between 1 and 5 mm.

The aforedescribed apparatus, including those actually shown in FIGS. 1, 2 and 3, constitute but a few apparatus which embody or can embody the present invention. For example, the conveyor part 21 of FIG. 2 (for use in an apparatus for making a single tobacco flow) can be modified for use in the apparatus of FIG. 1 in lieu of the conveyor part 251. Furthermore, the inclination of the upper side of the conveyor part 251 can be modified, if necessary, to achieve the conversion of the tobacco stream into tobacco flows exhibiting optimum characteristics for conversion into satisfactory rod-shaped fillers of tobacco rods. For example, the upper side of the conveyor part 251 can exhibit a more or less pronounced slope and can merge gradually into an at least substantially horizontal part prior to sloping upwardly toward the outlets 263 and 264. Otherwise stated, the upper side of the conveyor part 251 (as well as the surface 21*a* of the conveyor part 21) can include a downwardly sloping concave first portion, a plane (flat) median portion and one or more upwardly sloping downstream portions.

Gradual transition from preceding to the nextfollowing portions of the composite guide surface defined by the conveyor exhibits several important advantages. It is advisable to avoid the establishment of abrupt (such as stepwise) transitions between successive portions of the tobacco guiding surface or surfaces of the conveyor at least in the regions of orifices of the nozzles (such as 307, 303 and 258 in FIG. 1 and 23 in FIG. 2) because this renders it possible to achieve a highly effective singularization of tobacco particles. The envelope curve of the path or paths should not exhibit any abrupt transitions (such as steps, sharp edges or like causes of absence of homogeneousness of the tobacco flow or flows). Otherwise stated, the mathematical function of the path should be such that this path ensures a smooth advancement of tobacco particles in a direction toward the outlet or outlets of their elongated path.

Applicants are further aware of the disclosure in U.S. Pat. No. 3,648,035 granted Mar. 7, 1972 to Hart et al. for "SYSTEM AND METHOD FOR OPTIMIZING PROCESSOR OR EQUIPMENT PROFIT". This patent discloses a system for and a method of controlling the average weight of cigarettes by monitoring the spread of weights in a length of cigarette rod and by carrying out adjustments which are intended to ensure that the weight of each cigarette is still acceptable but enables the manufacturer to maximize the profitability of the cigarette making machines and methods. Furthermore, the patentees are concerned with reliable segregation of defective cigarettes from satisfactory cigarettes and with recovery of tobacco from segregated cigarettes. On the other hand, the method and apparatus of the present invention are intended to ensure the making of rod-shaped smokers' products in such a way that the number of rejects is reduced to a minimum.

German patent application No. 27 07 253 (published Nov. 3, 1977) discloses a duct wherein the density of an upright column of descending tobacco particles is variable by two sets of conveyors including first conveyors flanking the path of the column in the upper portion of the duct and second conveyors flanking the path of the column in the lower portion of the duct. The first and second conveyors are adjustable independently of each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating streams and analogous accumulations of tobacco or other particulate fibrous material and, therefore, such adaptations should and are intended to be comprehended within the meaning and range of equivalence of the appended claims.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for regulating density of elongated streams of particulate material, comprising:

a conveyor having an inlet and at least one outlet and defining at least one elongated path extending from said inlet to said at least one outlet;

means for treating a stream of particulate material in said conveyor, including:

a compacting unit to density successive increments of the stream downstream of said inlet thereby making said successive increments more dense and resulting in at least one flow wherein at least some of the particulate material are interlaced with each other, said increments moving at a speed; and at least one means for changing the speed of successive increments of the at least one flow in said conveyor to at least substantially singularize the particles not later than at said at least one outlet; and means for regulating an operation of at least one of said conveyor and said compacting unit, including at least one sensor arranged to monitor at least one of (a) a thickness of the at least one flow in said path, (b) density of the at least one flow in said path, and (c) pressure of air in a chamber adjacent said path in the region of said at least one outlet.

2. The apparatus of claim 1, further comprising means for advancing successive increments of the stream toward said inlet along a second path, and means for transferring successive increments of the stream from said second path into said inlet.

3. The apparatus of claim 1, wherein said compacting unit includes at least one pneumatic stream compacting device.

4. The apparatus of claim 3, wherein said at least one pneumatic compacting device comprises at least one nozzle arranged to direct at least one jet of a gaseous fluid against successive increments of the stream in said path.

5. The apparatus of claim 1, wherein said conveyor is arranged to advance the increments of the stream at a first speed and said at least one speed changing means includes means for advancing successive increments of the at least one flow at a second speed.

6. The apparatus of claim 5, wherein said at least one speed changing means has a surface extending in said conveyor in a direction from said inlet toward said at least one outlet and defining a portion of said path.

7. The apparatus of claim 6, wherein at least a portion of said surface has an arcuate shape.

8. The apparatus of claim 7, wherein said surface includes an at least substantially horizontal first portion and a second portion sloping upwardly in a direction from said at least substantially horizontal first portion toward said at least one outlet.

9. The apparatus of claim 8, wherein the slope of said second portion of said surface increases in said direction toward said at least one outlet.

10. The apparatus of claim 6, wherein said at least one speed changing means further includes at least one nozzle provided at said surface and arranged to direct at least one jet of a gaseous fluid against successive increments of the at least one flow in said conveyor.

11. The apparatus of claim 10, wherein said at least one nozzle is provided at an at least substantially smooth portion of said surface.

12. The apparatus of claim 10, wherein said at least one nozzle is located at said at least substantially horizontal first portion.

13. The apparatus of claim 1, wherein said at least one speed changing means includes at least one nozzle arranged to direct at least one particle accelerating jet of a gaseous fluid against successive increments of the at least one flow in said conveyor.

14. The apparatus of claim 13, wherein said at least one nozzle has at least one substantially slitshaped fluid discharging orifice.

15. The apparatus of claim 14, wherein said at least one orifice extends at least substantially transversely of at least a portion of said at least one path.

16. The apparatus of claim 13, wherein said at least one speed changing means further comprises an arcuate surface bounding a portion of said at least one elongated path between said at least one nozzle and said at least one outlet, said at least one nozzle having at least one orifice arranged to discharge into said at least one elongated path at least one jet of a gaseous fluid along an arcuate path merging gradually into said at least one elongated path.

17. The apparatus of claim 16, wherein at least one of said paths has an arcuate shape at least at the location of merger of a second path into said at least one elongated path.

18. The apparatus of claim 1, wherein said at least one speed changing means includes a plurality of discrete speed changing devices.

19. The apparatus of claim 18, wherein at least one of said devices includes at least one nozzle arranged to direct against successive increments of the at least one flow in said conveyor at least one particle accelerating jet of a gaseous fluid.

20. The apparatus of claim 1, wherein said conveyor includes at least two neighbouring sections and said at least one speed changing means includes a gas discharging nozzle having an orifice defined by said sections of said conveyor.

21. The apparatus of claim 1, wherein the means for compacting includes at least one of a funnel-shaped conveyor, which at its narrowest point causes an elongated stream of particulate matter to condense, and means for generating an air flow that causes an elongate stream to condense.

22. A method of making at least one flow of particles of fibrous material, comprising the steps of:

advancing a stream of particles from a first path into an inlet of at least one elongated second path having at least one outlet remote from the inlet, compacting successive increments of the stream at said inlet with attendant interlacing of at least some particles in successive increments thereby obtaining at least one flow monitoring at least one of (a) a thickness of the at least one flow, (b) density of the at least one flow, and (c) pressure of air in a chamber adjacent said second path in the region of said at least one outlet; and accelerating successive increments of the at least one flow in said second path to at least substantially singularize the particles not later than at the at least one outlet.

23. The method of claim 22, wherein said accelerating step includes directing against successive increments of the at least one flow at least one jet of a gaseous fluid.

24. The method of claim 22, wherein said advancing step further includes moving the stream at a first speed and said compacting step includes reducing the speed of successive increments of the stream from said first speed to a second speed.

25. The method of claim 24, wherein said compacting step includes directing against successive increments of the at least one flow at least one second jet of a gaseous fluid.

26. The method of claim 23, wherein the step of directing against successive increments of the at least one flow at least one jet of a gaseous fluid includes at least one jet of gaseous fluid being directed mainly in the direction of transportation of the flow.

27. The method of claim 23, wherein said accelerating step takes place in a predetermined portion of said second path, and further comprising a step of densifying the at least one flow between said inlet and said predetermined portion of said second path.

28. The method of claim 23, wherein said compacting step includes imparting to successive increments of the at least one flow a density which is at least substantially uniform as seen transversely of said second path.

29. The method of claim 23, wherein said accelerating step includes propelling the particles along the second path at least substantially in a direction toward the outlet of the second path.

30. The method of claim 23, further comprising a step of regulating at least one of (a) speed of the at least one flow in said second path, and (b) speed of the at least one jet.

31. The method of claim 30, wherein said regulating step includes establishing a pressure differential between longitudinally spaced apart sections of the elongated second path.

32. The method of claim 23, further comprising a step of regulating height of the flow.

33. The method of claim 23, further comprising the step of regulating at least one of (a) speed of the at least one flow in said second path, (b) speed of the at least one jet, and an amount of air being carried away.

34. The method of claim 22, wherein said accelerating step further includes causing successive increments of the at least one flow to advance along a guide surface bounding at least a portion of the second path and establishing a flow of gaseous fluid between the guide surface and the at least one flow in said second path, wherein the flow of gaseous fluid is close to the guide surface.

35. The method of claim 22, wherein the stream constitutes a sifted mass of tobacco particles.

36. The method of claim 22, further comprising a step of discharging successive increments of the at least one flow from the at least one outlet of the second path into a rod forming station of a tobacco rod making machine.

37. The method of claim 36, wherein the advancing and accelerating steps are carried out in a hopper of the tobacco rod making machine.

38. The method of claim 37, further comprising a step of withdrawing some of the gaseous fluid by suction from the second path upstream of the at least one outlet.

39. The method of claim 22, wherein said advancing step includes advancing tobacco particles into a second path having outlets for a plurality of discrete flows.

40. The method of claim 39, wherein the tobacco rod making machine is arranged to convert the discrete flows of tobacco particles into two discrete tobacco rods.

41. The method of claim 40, wherein the advancing step includes establishing two discrete second paths each extending from said inlet to a different outlet.

42. The method of claim 22, further comprising a step of subdividing the stream in said at least one second path into a plurality of flows subsequent to completion of said accelerating step.

* * * * *